US005903202A

United States Patent [19]

Endoh et al.

[11] Patent Number: 5,903,202

[45] Date of Patent: May 11, 1999

[54] REED RELAY AND METHOD FOR FABRICATION THEREOF

[75] Inventors: Tomohisa Endoh; Tsutomu Motoyama, both of Nagano, Japan

[73] Assignee: Fujitsu Takamisawa Component Limited, Tokyo, Japan

[21] Appl. No.: 08/748,578

[22] Filed: Nov. 13, 1996

[30] Foreign Application Priority Data

Jul. 16, 1996 [JP] Japan ..... 8-185920

[51] Int. Cl.[6] ..... H01H 1/66

[52] U.S. Cl. ..... 335/151; 335/152; 361/162

[58] Field of Search ..... 335/151, 152, 335/154, 255; 361/162

[56] References Cited

U.S. PATENT DOCUMENTS

| | | | |
|---|---|---|---|
| 3,575,678 | 4/1971 | Barton | 335/151 |
| 3,760,311 | 9/1973 | Zimet et al. | 335/152 |
| 3,940,722 | 2/1976 | Fox et al. | 335/151 |
| 4,112,478 | 9/1978 | Takahasi et al. | 361/162 |
| 4,136,321 | 1/1979 | Smith | 335/151 |
| 4,908,593 | 3/1990 | Takayanagi | 335/255 |
| 5,438,307 | 8/1995 | Chou | 335/151 |

*Primary Examiner*—Renee S. Luebke
*Assistant Examiner*—Tuyen T. Nguyen
*Attorney, Agent, or Firm*—Staas & Halsey

[57] ABSTRACT

A reed relay comprising a reed switch having a pair of leads and a magnetic coil assembly for driving the reed switch, the magnetic coil assembly being composed of a magnetic coil wound around a cylindrical bobbin having an insulating flange at each end of the cylindrical bobbin, a terminal insulator integrally continuous with each flange, and a plurality of terminal leads insulated from one another by each of the terminal insulators. One embodiment of the present invention is a cylindrical bobbin having an electric conductivity so as to act as an electrostatic shield for the reed switch inserted thereinto, and another embodiment of the present invention is a method for fabricating the magnetic coil assembly comprising a step of forming a cylindrical bobbin and the terminal leads in each side of the cylindrical bobbin by using a patterned sheet of metal, wherein the cylindrical bobbin is continuous with the ground terminal lead in each side.

5 Claims, 3 Drawing Sheets

REED RELAY AND METHOD FOR FABRICATION THEREOF

FIELD OF THE INVENTION

This invention relates to a reed relay having a reed switch and a coil assembly for switching the reed switch, particularly to a structure and fabrication method of the coil assembly having a coil bobbin into which the reed switch is inserted.

DESCRIPTION OF THE PRIOR ART

An example of a conventional reed relay is shown in FIG. 1, the example consisting of a reed switch 3 having leads 31 and a coil assembly 1 having a cylindrical static shield of metal 4. The cylindrical static shield 4 is inserted into a through hole 11 of a coil bobbin of resin 12 and fixed to the central one of terminal leads 14 at both ends of the coil bobbin 12 by spot welding where the terminal lead 14 is to be grounded. A pair of flanges 13 and terminal isolations 17 are formed by insert molding to fix with both ends of the coil bobbin 12, around which a coil wire is wound to form a magnetic coil 2 as shown by a partial cutout view. Thus, the reed switch 3 is inserted in the cylindrical static shield 4, where the leads 31 and ends of the coil wire are fixed to terminal leads 15 and 16 at both outsides of the flanges by soldering, respectively. The reed switch 3 makes a contact close (or ON) by a magnetic force exerted by the magnetic coil 2 while a current flows in the magnetic coil 2, in which the cylindrical static shield 4 prevents the reed switch 3 from being erroneously driven by external electric noises. In the conventional reed relay as described above, the use of so many parts and components manufactured separately incurs much material costs and processing costs to assemble them into a complete set of the reed relay. Further, considerable spatial clearances are needed between the reed switch 3 and the cylindrical static shield of metal 4 and also between the cylindrical static shield of metal 4 and the coil bobbin 12, respectively, which results in inefficient occupancy of space, which increases a total volume of the reed relay if the number of coil turns are maintained constant or decreases number of the coil turn if the total volume is maintained as a constant. The highest efficiency in driving characteristics is usually attained when the reed contact is aligned to the center of the coil bobbin 12. However, it is difficult to align the reed contact to the desires position in the axial direction of the coil bobbin 12 if the reed contact is simply cut into a certain length. These drawbacks are structurally unavoidable in the conventional reed relay.

SUMMARY OF THE INVENTION

An object of the present invention is to provide a reed relay having an increased coil space to generate the highest possible magnetic force without increasing the total volume of the reed relay.

Another object of the present invention is to provide a reed relay having a monolithic structure of a coil bobbin composed of a cylindrical static shield and a plurality of terminal leading to simplifying the assembly processing steps.

A further object of the present invention is to provide a reed relay having a self aligning structure of a reed switch to the right position in a coil bobbin such that the highest efficiency in driving characteristics is always attained.

BRIEF DESCRIPTION OF THE DRAWINGS

The present invention will be more apparent from the following description, when taken to conjunction with the accompanying drawings, in which.

DESCRIPTION OF THE PREFERRED EMBODIMENTS

Reference will now be made in detail to the preferred illustrated embodiments of the invention, examples of which are illustrated in the accompanying drawings. While the invention will be described in conjunction with the preferred illustrated embodiments, it will be understood that these embodiments are not intended to limit the invention. On the contrary, the invention is intended to cover alternatives, modifications, and equivalents, which are included within the spirit and scope of the invention as defined by the appended claims.

Figure 1:
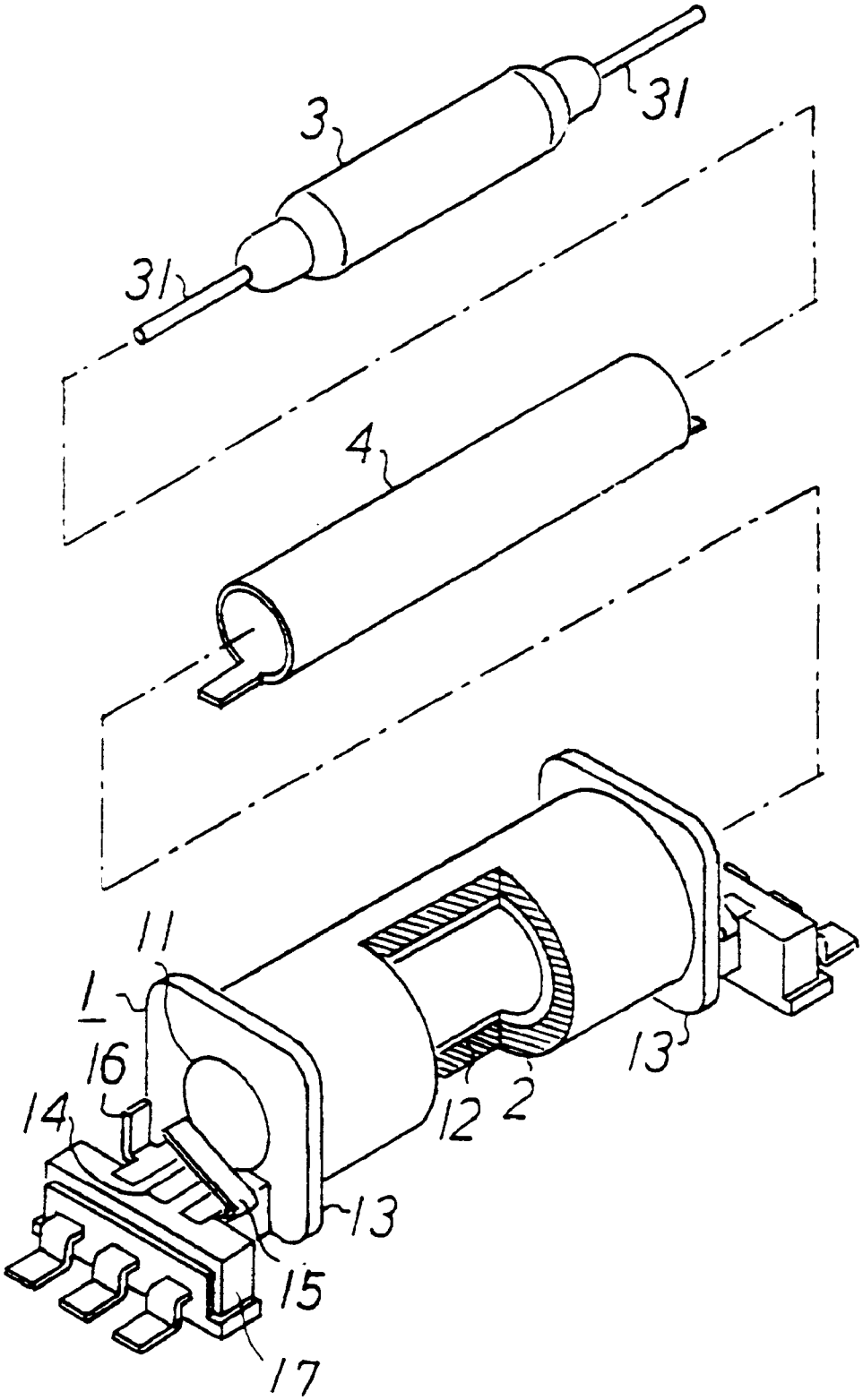
FIG. 1 PRIOR ART
FIG. 1 is an exploded view having a partial cutout for a conventional reed relay.
Figure 2:
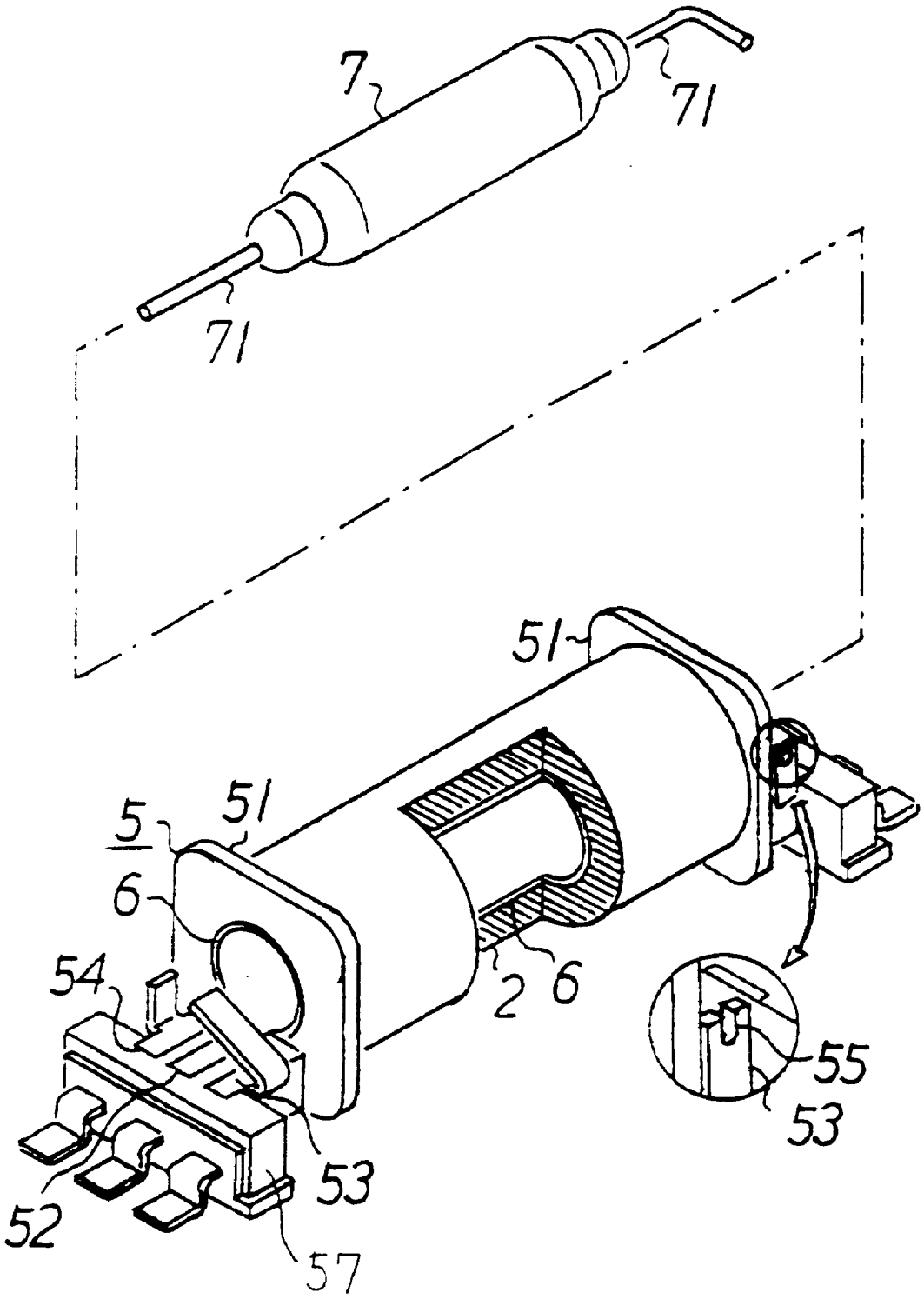
FIG. 2 is an exploded view having a partial cutout for a reed relay according to the present invention.

Referring to FIG. 2, a reed relay consists of a reed switch 7 having leads 71 and the coil assembly 5 having a monolithic coil bobbin 6 in which the reed switch 7 is inserted. The coil bobbin 6, usually made of copper, acts as a cylindrical static shield for the reed switch 7, and the coil bobbin 6 is integrally continuous with the first terminal leads 52 at both sides of the coil bobbin 6, which are to be grounded. The second, and third terminal leads 53, 54 are connected with each end of the coil wire, and each lead of the reed switch by soldering, respectively. These three terminal leads 52, 53, 54 are isolated from one another by terminal insulator 57. The coil bobbin 6 has an insulating layer of resin, shown as 12 in FIG. 1, formed therein as can be seen by the cut-away view of FIG. 2. The coil bobbin of copper 6 has a pair of flanges 51 at both ends around which a magnetic coil 2 is directly formed as shown in a cutout view. The flanges 51 and terminal insulator 57 are simultaneously formed by insert molding. It should be noticed that one of the leads 71 of the reed switch 7 is bent in an L-shape at a certain position, which is engaged with a notch 55 formed in an end of one of the terminal leads 53 to be soldered. Another lead 71 is also soldered to the terminal lead 53 at the opposite side. The L-shaped terminal lead 53 enables a self-alignment of the reed contact to the right position in the magnetic coil where the maximum magnetic force is exerted.

Figure 3A:
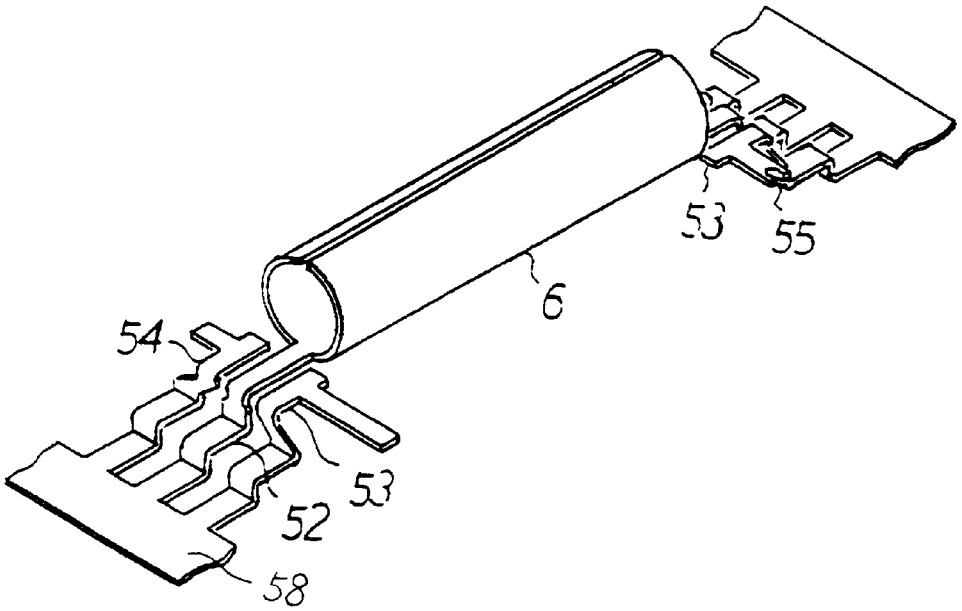
FIGS. 3A and 3B are perspective views of a monolithic structure of a coil bobbin and terminal leads with and without insert molded parts, respectively, for the reed relay according to the present invention.

Referring to FIG. 3A, the monolithic coil bobbin 6, made of a continuous sheet of copper, is composed of a cylindrical part which is a cylindrical static shield, and terminal leads 52, 53, 54 supported by lead frames 58. The monolithic structure of the coil bobbin 6 as shown in FIG. 3A is originally provided by a patterned sheet of copper supported by parallel lead frames, which has a rectangular pattern for a coil bobbin and a plurality of terminal lead patterns in both sides of the rectangular pattern. The first step of the lead frame process is to curl the rectangular pattern into a cylindrical coil bobbin and deform the terminal lead patterns so as to fit the terminal insulators by pressing. Since the coil wire is directly wound around the cylindrical part of the coil bobbin 6 which also acts as a cylindrical electrostatic shield, the reed relay according to the present invention does not need as much clearance between the cylindrical static shield 4 and the coil bobbin 12 as in the prior art shown in FIG. 1. This can save a considerable space for additional turns of the magnetic coil. One specific example shows that as much as 30% in numbers of coil turn increased. This results in lower power consumption of the magnetic coil or a smaller volume of the reed relay having the same magnetic force.

Figure 3B:
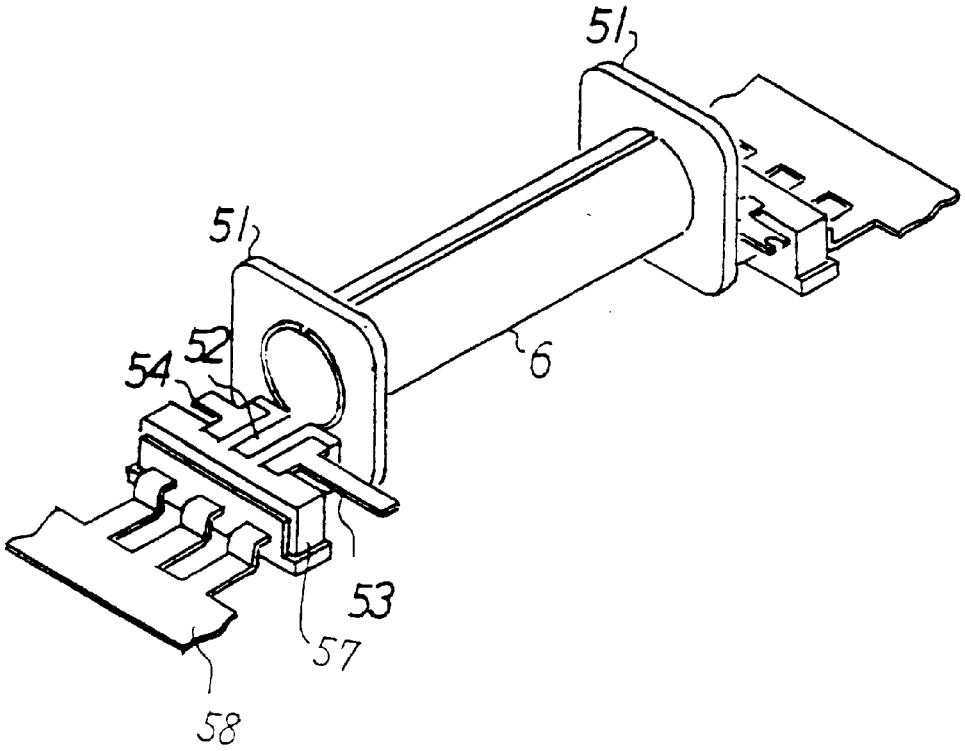

Referring to FIG. 3B, a pair of the flanges 51 and terminal insulators 57 are simultaneously formed by insert molding at both ends of the cylindrical part 6, around which an insulated coil wire is directly wound between the flanges 51. At a final stage, the terminal lead frames 58 are cut off to complete the magnetic coil assembly. Since the cylindrical part is continuously integrated with the terminal leads, unlike the prior art shown in FIG. 1, the processing step has become simple by which improvements in not only material and manufacturing costs but also reliability are expected.

What is claimed is:

1. A reed relay comprising:

a reed switch having a pair of leads; and a magnetic coil assembly for driving the reed switch, the magnetic coil assembly including a bobbin having opposite ends and respective insulating flanges at the opposite ends and a hole extending therethrough, the reed switch being inserted into the hole in the bobbin, a magnetic coil wound around the bobbin, terminal insulators connected with an exterior of each flange, and a plurality of terminal leads supported on and insulated from one another by the terminal insulators disposed at each of the opposite ends of the bobbin, one of the terminal leads being integrally continuous with the bobbin, the bobbin being electrically conductive and functioning as an electrostatic shield for the reed switch.

2. The reed relay according to claim 1, wherein the plurality of terminal leads comprises first, second and third terminal leads disposed at each of the opposite ends of the bobbin, the first, second, and third terminal leads being integral with one of the opposite ends of the bobbin, connected to an end of the magnetic coil, and connected to one of the leads of the reed switch, respectively.

3. The reed relay according to claim 2, wherein the third terminal lead includes a notch at an end thereof such that one lead of the reed switch is engaged with the notch so as to position said reed switch in a desired position in the magnetic coil assembly.

4. The reed relay according to claim 3, wherein the one lead of the reed switch engageable with the notch is bent in an L-shape such that the reed switch is in the desired position in the magnetic coil assembly when the one lead is engaged with the notch.

5. The reed relay according to claim 1, wherein the magnetic coil is directly formed on a surface of the bobbin.

* * * * *

UNITED STATES PATENT AND TRADEMARK OFFICE

CERTIFICATE OF CORRECTION

PATENT NO. : 5,903,202
DATED : May 11, 1999
INVENTOR(S) : Tomohisa ENDOH et al.

It is certified that error appears in the above-indentified patent and that said Letters Patent is hereby corrected as shown below:

Col. 3, line 18, after "bobbin" insert --made of metal--.

Col. 4, line 2, after "leads" insert --and the bobbin-- and after "being" insert --formed of a single piece of metal sheet and being--;

line 3, change "the bobbin," to --each other, the reset of the terminal leads separated from the bobbin are also formed of the same metal sheet as the bobbin--;

line 16, after "position" (first occurrence) insert --another lead opposite to said one lead-- and after "position" (second occurrence) insert --on the respective third terminal lead--;

line 20, after "L-shape" insert --while an opposite lead is straight--.

Signed and Sealed this

Nineteenth Day of October, 1999

*Attest:*

*Attesting Officer*

Q. TODD DICKINSON

*Acting Commissioner of Patents and Trademarks*